US006165107A

United States Patent [19]

Birrell

[11] Patent Number: 6,165,107

[45] Date of Patent: Dec. 26, 2000

[54] FLEXIBLY COORDINATED MOTION ELLIPTICAL EXERCISER

[75] Inventor: James S. Birrell, Seattle, Wash.

[73] Assignee: Illinois Tool Works Inc., Glenview, Ill.

[21] Appl. No.: 09/271,733

[22] Filed: Mar. 18, 1999

[51] Int. Cl.[7] ..... A63B 22/00; A63B 22/04

[52] U.S. Cl. ..... 482/70; 482/52; 482/51

[58] Field of Search ..... 482/51, 52, 53, 482/57, 70, 71, 79, 80, 148

[56] References Cited

U.S. PATENT DOCUMENTS

| | | |
|---|---|---|
| 219,439 | 9/1879 | Blend . |
| D. 229,369 | 11/1973 | Smith et al. . |
| D. 330,236 | 10/1992 | Jarriel et al. . |
| D. 372,282 | 7/1996 | Pasero . |
| D. 408,477 | 4/1999 | Arnold et al. . |
| D. 410,978 | 6/1999 | Littrell et al. . |
| 518,757 | 4/1894 | Hoyt . |
| 1,273,906 | 7/1918 | Nickey . |
| 1,323,004 | 11/1919 | Boyd . |
| 2,603,486 | 7/1952 | Hughes . |
| 2,641,249 | 6/1953 | Brockman . |
| 2,826,192 | 3/1958 | Mangas . |
| 2,892,455 | 6/1959 | Hutton . |
| 3,316,898 | 5/1967 | Brown . |
| 3,432,164 | 3/1969 | Deeks . |
| 3,475,021 | 10/1969 | Ruegsegger . |
| 3,566,861 | 3/1971 | Weiss . |
| 3,713,438 | 1/1973 | Knutsen . |
| 3,759,511 | 9/1973 | Zinkin et al. . |
| 3,824,994 | 7/1974 | Soderberg, Sr. . |
| 4,023,795 | 5/1977 | Pauls . |
| 4,053,173 | 10/1977 | Chase, Sr. . |
| 4,185,622 | 1/1980 | Swenson . |
| 4,188,030 | 2/1980 | Hooper . |
| 4,379,566 | 4/1983 | Titcomb . |
| 4,456,276 | 6/1984 | Bortolin . |
| 4,505,473 | 3/1985 | Pro . |
| 4,509,742 | 4/1985 | Cones . |
| 4,555,109 | 11/1985 | Hartmann . |
| 4,561,318 | 12/1985 | Schirrmacher . |
| 4,645,200 | 2/1987 | Hix . |
| 4,679,786 | 7/1987 | Rodgers . |
| 4,700,946 | 10/1987 | Breunig . |

(List continued on next page.)

FOREIGN PATENT DOCUMENTS

| | | |
|---|---|---|
| 29 19 494 | 11/1980 | Germany . |
| 0206208 | 7/1939 | Switzerland . |
| 1600816 | 10/1990 | U.S.S.R. . |

*Primary Examiner*—Stephen R. Crow
*Attorney, Agent, or Firm*—Christensen O'Connor Johnson Kindness PLLC

[57] ABSTRACT

An exerciser (10) includes a floor engaging frame (14), towards the rear of which are attached left and right axle mount supports (22) and (24), that house a transverse axle (26). The axle (26) connects the left and right drive wheels (30) and (32). Rear portions of left and right foot link members (36) and (38) rollably engage the drive wheels. Front portions of the foot link members rollably engage left and right inclinable guide ramps (60) and (62). The inclinable guide ramps are biased rotationally upwardly, by a ramp return assembly (70) that causes one ramp to pivot downwardly as the other ramp pivots upwardly. Forward and rearward pulley and belt systems (72) and (76) are connected to the foot links and provide flexibly coordinated motion which substantially relates the movement of the first and second foot links to each other, while permitting some degree of uncoordinated motion between the foot links. When the foot link members reciprocate along the inclinable guide ramps, the interaction between the oscillating weight of a user and the upwardly biased guide ramps, causes the foot support portions to travel along elliptical paths.

48 Claims, 10 Drawing Sheets

U.S. PATENT DOCUMENTS 4,720,093 1/1988 Del Mar .
4,779,863 10/1988 Yang .
4,786,050 11/1988 Geschwender .
4,842,268 6/1989 Jenkins .
4,869,494 9/1989 Lambert, Sr. .
4,900,013 2/1990 Rodgers, Jr. .
4,949,954 8/1990 Hix .
4,949,993 8/1990 Stark et al. .
4,986,261 1/1991 Iams et al. .
4,989,857 2/1991 Kuo .
5,029,848 7/1991 Sleamaker .
5,038,758 8/1991 Iams et al. .
5,039,087 8/1991 Kuo .
5,039,088 8/1991 Shifferaw .
5,131,895 7/1992 Rogers, Jr. .
5,135,447 8/1992 Robards, Jr. et al. .
5,149,312 9/1992 Croft et al. .
5,169,363 12/1992 Campanaro et al. .
5,186,697 2/1993 Rennex .
5,242,343 9/1993 Miller .
5,269,736 12/1993 Roberts .
5,279,529 1/1994 Eschenbach .
5,279,530 1/1994 Hess .
5,290,211 3/1994 Stearns .
5,295,928 3/1994 Rennex .
5,299,993 4/1994 Habing .
5,336,141 8/1994 Vittone ..... 482/51
5,352,169 10/1994 Eschenbach .
5,383,829 1/1995 Miller .
5,387,167 2/1995 Johnston .
5,401,226 3/1995 Stearns .
5,403,255 4/1995 Johnston .
5,423,729 6/1995 Eschenbach .
5,499,956 3/1996 Habing et al. .
5,518,473 5/1996 Miller .
5,527,246 6/1996 Rodgers, Jr. .
5,529,554 6/1996 Eschenbach .
5,540,637 7/1996 Rodgers, Jr. .
5,549,526 8/1996 Rodgers, Jr. .
5,562,574 10/1996 Miller .
5,573,480 11/1996 Rodgers, Jr. .
5,577,985 11/1996 Miller .
5,593,371 1/1997 Rodgers, Jr. .
5,593,372 1/1997 Rodgers, Jr. .
5,595,553 1/1997 Rodgers, Jr. .
5,611,756 3/1997 Miller .
5,637,058 6/1997 Rodgers, Jr. .
5,653,662 8/1997 Rodgers, Jr. .
5,683,333 11/1997 Rodgers, Jr. .
5,685,804 11/1997 Whan-Tong et al. .
5,690,589 11/1997 Rodgers, Jr. .
5,738,614 4/1998 Rodgers, Jr. .
5,743,834 4/1998 Rodgers, Jr. .
5,766,113 6/1998 Rodgers, Jr. .
5,772,558 6/1998 Rodgers, Jr. .
5,848,954 12/1998 Stearns et al. .
5,857,940 1/1999 Husted ..... 482/52
5,857,941 1/1999 Maresh et al. .
5,897,461 4/1999 Socwell .
6,030,319 2/2000 Wu ..... 482/70

FLEXIBLY COORDINATED MOTION ELLIPTICAL EXERCISER

FIELD OF THE INVENTION

The present invention relates to exercise equipment, and more specifically to a flexibly coordinated motion exerciser for simulating running, jogging and stepping type motions.

BACKGROUND OF THE INVENTION

The benefits of regular aerobic exercise have been well established and accepted. However, due to time constraints, inclement weather, and other reasons, many people are prevented from aerobic activities such as walking, jogging, running, and swimming. In response, a variety of exercise equipment have been developed for aerobic activity. It is generally desirable to exercise a large number of different muscles over a significantly large range of motion so as to provide for balanced physical development, to maximize muscle length and flexibility, and to achieve optimum levels of aerobic exercise. A further advantageous characteristic of exercise equipment, is the ability to provide smooth and natural motion, thus avoiding significant jarring and straining that can damage both muscles and joints.

While various exercise systems are known in the prior art, these systems suffer from a variety of shortcomings that limit their benefits and/or include unnecessary risks and undesirable features. For example, stationary bicycles are a popular exercise system in the prior art, however this machine employs a sitting position which utilizes only a relatively small number of muscles, throughout a fairly limited range of motion. Cross-country skiing devices are also utilized by many people to simulate the gliding motion of cross-country skiing. While this device exercises more muscles than a stationary bicycle, the substantially flat shuffling foot motion provided thereby, limits the range of motion of some of the muscles being exercised. Another type of exercise device simulates stair climbing. These devices also exercise more muscles than do stationary bicycles, however, the rather limited range of up-and-down motion utilized does not exercise the user's leg muscles through a large range of motion. Treadmills are still a further type of exercise device in the prior art, and allow natural walking or jogging motions in a relatively limited area. A drawback of the treadmill, however, is that significant jarring of the hip, knee, ankle and other joints of the body may occur through use of this device.

A further limitation of a majority of exercise systems in the prior art, is that the systems are limited in the types of coordinated elliptical motions that they can produce. Exercise systems create elliptical motion, as referred to herein, when the path traveled by a user's feet while using the exercise system follows an arcuate or ellipse-shaped path of travel. Elliptical motion is much more natural and analogous to running, jogging, walking, etc., than the linear-type, back and forth motions produced by some prior art exercise equipment. Coordinated elliptical motion is produced when the elliptical motions of a user's feet are linked together, so that one foot is forced to move forward in response to the rearward movement of the other foot (in substantially an equal and opposite amount). Limiting the range of elliptical motions utilized by the exercise systems can result in detrimental effects on a user's muscle flexibility and coordination due to the continued reliance on the small range motion produced by some prior art exercise equipment, as opposed to the wide range of natural elliptical motions that are experienced in activities such as running, walking, etc.

Further, the exercise systems in the prior art produce various types of forced coordinated elliptical motion. There is a continuing need for an exercise device that provides for smooth natural action, exercises a relatively large number of muscles through a large range of motion, and allows for flexibly coordinated elliptical motion, i.e., elliptical motion that is substantially coordinated but still allows for some independent or uncoordinated motion between the movement of the user's feet.

SUMMARY OF THE INVENTION

The present invention is directed towards an exercise device that allows flexibly coordinated elliptical motion to be produced. The exercise device utilizes a frame that is configured to be supported on a floor. The frame defines an axis to which the first and second foot links are operatively associated. The first and second foot links each have a forward end, a rearward end and a foot supporting portion. The connection between the foot links and the transverse axle causes the foot supporting portions of the foot links to travel along arcuate paths relative to the transverse axle.

The transverse axis is further operationally associated with a capstan drive and a one-way clutch system such that there is a greater resistance required to move the foot portions of the foot links from the forward to rearward positions, than there is to move the foot portions from the rearward to the forward positions. The device may also include a means for increasing the amount of resistance required to move the foot portions through the elliptical path, thereby increasing the level of energy output required from the user.

In one preferred embodiment, the present invention contains first and second guide ramps that are supported by the frame and are operatively associated with the forward ends of the first and second foot links, so as to direct the foot links along flexibly coordinated paths of travel, as the foot support portions of the foot links travel along variable flexibly coordinated elliptical paths of motion (i.e. the motion of the foot links is substantially related to one other, but not direct one-to-one coordinated motion). The transverse axle is operatively connects to a capstan drive, whereby the foot links each sweep out a elliptical path along a closed pathway. The drive system is a bifurcated apparatus that allows the two foot links to move in related, flexibly coordinated motion to one another.

In another aspect of a preferred embodiment, the exercise device may contain guide ramps that are operationally induced incline-varying ramps. Specifically, the interaction of the foot links with the guide ramps acts to vary the angular orientation of the guide ramps, and thus the foot links relative to the frame. The biasing mechanism of the guide ramps is preferably either spring based, a teeter-totter type design, or a rope and pulley type design.

In yet another aspect of a preferred embodiment, the exercise device may contain foot links that are connected to each other by a pulley and belt system that urges one foot link to translate towards the forward end of the frame as the other foot link translates towards the rearward end of the frame. This belt of the pulley and belt system is flexible, allowing the foot links to be flexibly coordinated in substantially related movement to one another.

In an aspect of another preferred embodiment, the exercise device may contain foot links that are connected to each other by a rack and pinion system that causes one foot link to translate towards the forward end of the frame as the other foot link translates towards the rearward end of the frame.

This rack and pinion system has a flexible draw that allows the foot links to be flexibly coordinated in substantially related movement to one another.

Still a further preferred embodiment of the present invention may contain foot links that are operatively connected to the transverse axle by rotational crank arms. These rotational crank arms are connected through a system that allows the foot links to move in substantially related, flexibly coordinated motion to one another.

An exercise device constructed in accordance with the present invention implements variable, flexibly coordinated elliptical motion to simulate natural walking and running motions and exercise a large number of muscles through a large range of motion. Increased muscle flexibility and coordination can also be derived through the natural variable, flexibly coordinated bi-pedal motion of the present invention, as opposed to the limited range of motions produced by some prior art exercise equipment. This device provides the above stated benefits without imparting the shock to the user's body joints in the manner of prior art exercise treadmills.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
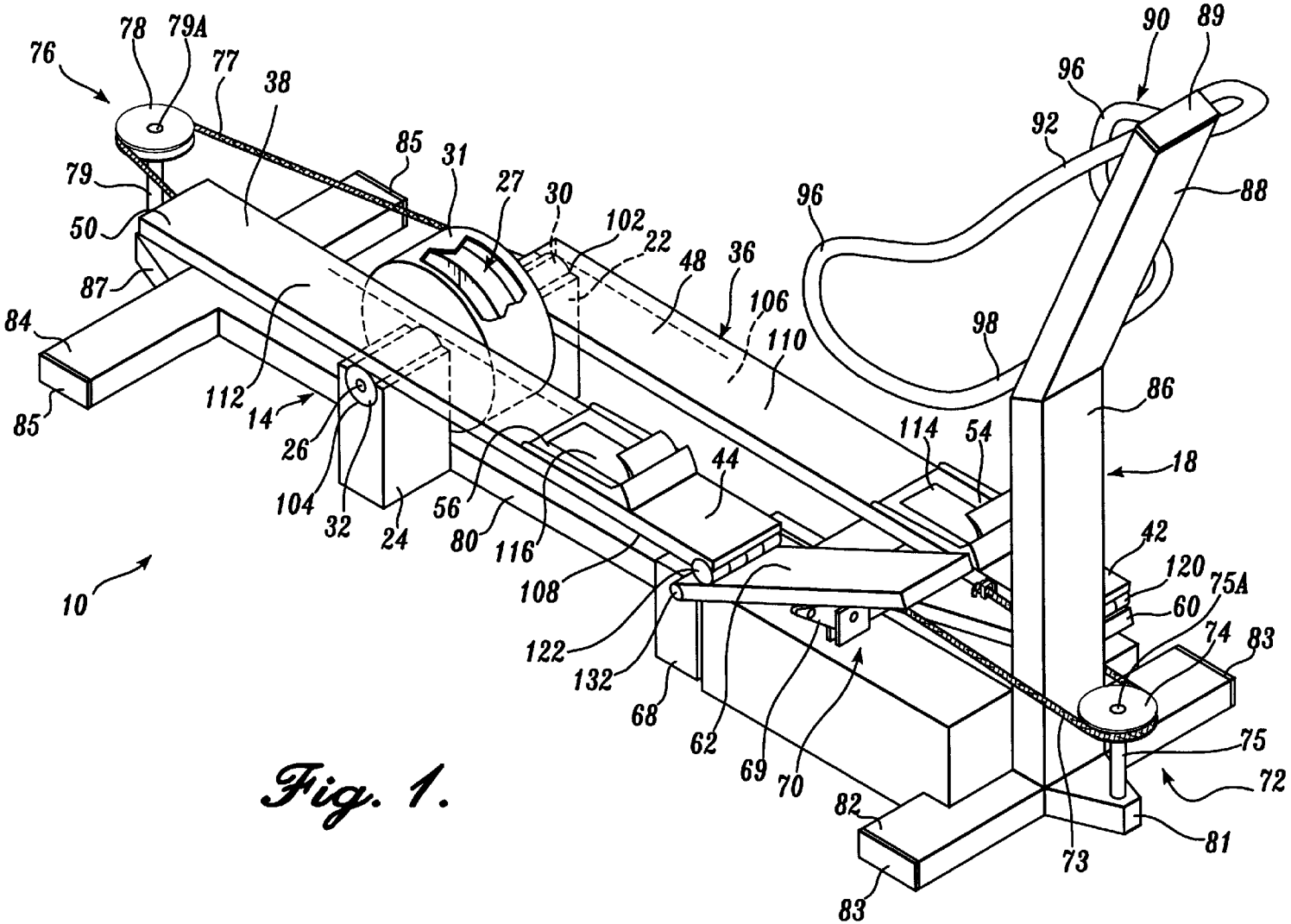
FIG. 1 illustrates a perspective view of an flexibly coordinated motion elliptical exerciser of the present invention, utilizing teeter-totter type guide ramp returns that is flexibly coordinated by a belt and pulley system.
Figure 2:
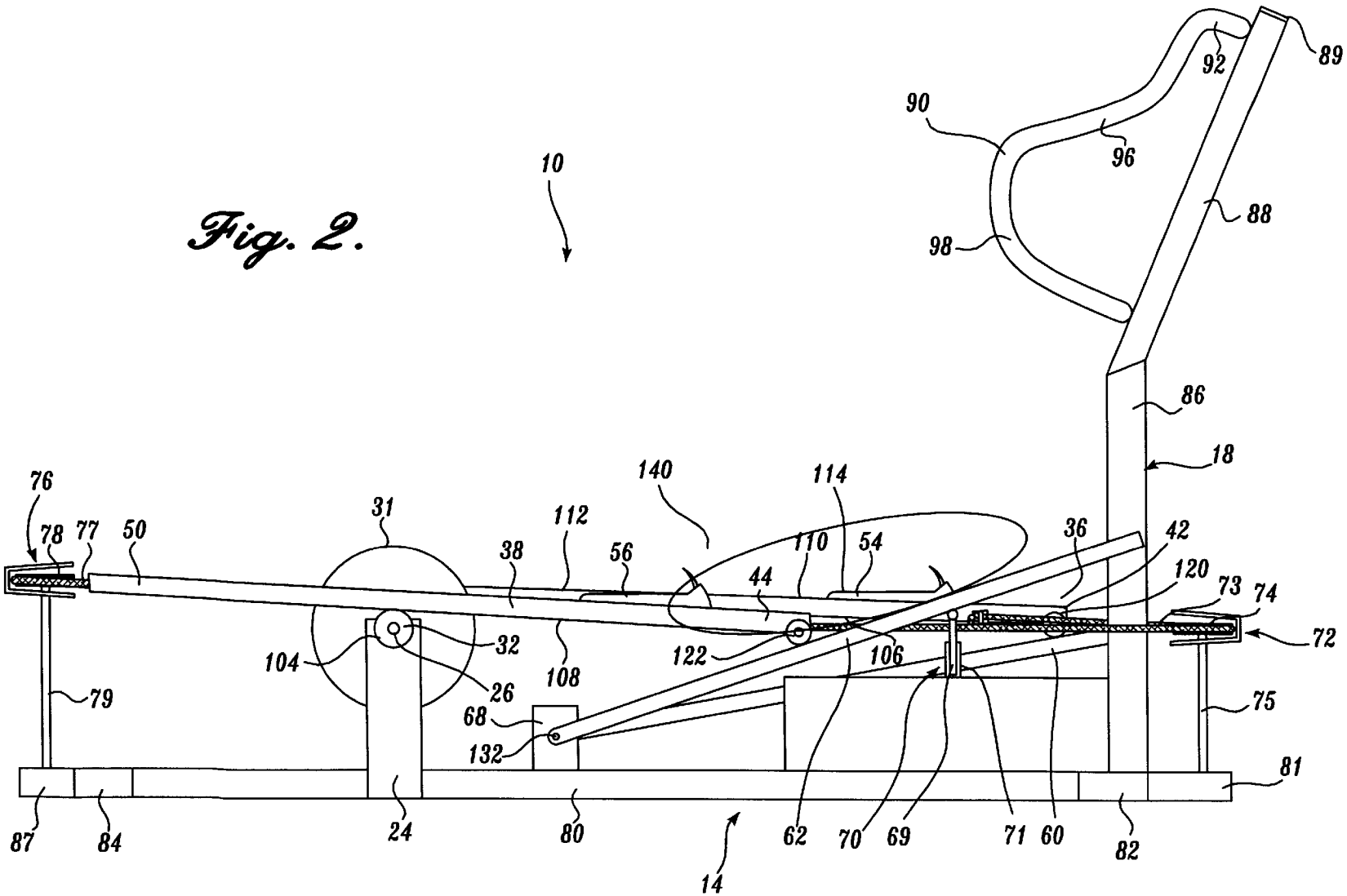
FIG. 2 illustrates a side elevation view of the embodiment of the present invention shown in FIG. 1.

FIGS. 1 and 2 illustrate a preferred embodiment of a variable, flexibly coordinated elliptical motion exerciser 10 constructed in accordance with the present invention. Briefly described, the exerciser 10 includes a floor engaging frame 14 having a forward upright structure 18 that extends initially upwardly and then angles diagonally forward. Towards the rear region of the frame 14 are upwardly extending left and right axle mount supports 22 and 24 which support a transverse axle 26. The axle 26 is bifurcated, preferably at its center, which allows the two halves to rotate in flexibly coordinated motion to one another, connecting left and right drive wheels 30 and 32 respectively. Left and right foot link members 36 and 38 have rear end portions 48 and 50 that rollably engage the transverse axle 26. The transverse axle 26 is connected to a flywheel 27 contained within a center housing 31. The foot link members have forward end portions 42 and 44 that rollably engage left and right inclinable guide ramps 60 and 62. The inclinable guide ramps 60 and 62 are biased rotationally upwardly, by a transverse pivot-arm return assembly 70 that is constructed to cause one ramp to pivot downwardly as the other ramp pivots upwardly in response to downward forces incurred from the foot links 36 and 38.

The exerciser 10 further includes forward and rearward pulley and belt systems 72 and 76 that generates flexibly coordinated motion of the foot links, such that when one of the foot links moves in one direction (forward or rearward) the pulley and belt systems 72 and 76 cause the other foot link to move in the opposite direction (rearward or forward). The belts 73 and 77 of the systems 72 and 76 are stretchable, which produces the flexible aspect of the coordinated motion. Left and right foot support portions 54 and 56 containing toe straps or cups that are mounted on the foot link members 36 and 38 to aid in forward motion recovery. The foot link members 36 and 38 reciprocate forwardly and rearwardly along the inclinable guide ramps 60 and 62, causing interaction between the oscillating weight of a running or walking user on the foot support portions 54 and 56, and the coordinated upwardly biased inclinable guide ramps 60 and 62. This results in the foot support portions 54 and 56 carried by the foot link members 36 and 38 traveling along various elliptical paths, as described more fully below.

Describing the embodiment of the present invention as shown in FIGS. 1 and 2 in more detail, frame 14 includes a longitudinal central member 80 that terminates at front and rear, relatively shorter transverse members 82 and 84. Ideally, but not essentially, the frame 14 is composed of rectangular tubular members, that are relatively light in weight but that provide substantial strength and rigidity. Preferably, end caps 83 are securably connected to the opened ends of the transverse members 82 and 84 to close off the ends of these members.

The forward structure 18 extends upwardly from the floor engaging frame 14. The upright structure contains a lower substantially vertical section 86 which transitions into an upper, diagonal forwardly extending section 88. Ideally, but not essentially, the vertical section 86 and the diagonal section 88 may also be composed of rectangular tubular material, as described above. Preferably, an end cap 89 is also securably connected to the upper end of the diagonal section 88 to close off the opening therein.

A continuous, closed loop-type tubular handlebar 90 is mounted on the diagonal section 88 for grasping by an individual while utilizing the present exerciser 10. Although any number of handlebar configurations could be utilized without departing from the scope of the present invention, the following is a description of one possible embodiment. The handlebar 90 includes an upper transverse section 92 that is securely attached to the upper region of the diagonal section 88 by way of a clamp or other structure, not shown. The handlebar 90 further includes side sections 96, each of which are composed of an upper diagonally disposed section that transitions into a lower section which flares downwardly and outwardly. The side sections 96 conclude by transitioning into a lower transverse section 98 that is attached at its center to the diagonal forward section 88 in the above-described manner. Although not shown, the handlebar 90 may be covered in whole or in part by a gripping material or surface, such as foam rubber.

In the exemplary preferred embodiment shown in FIGS. 1 and 2, left and right axle mount supports 22 and 24 are located towards the rear of the frame 14. The axle supports are attached to the frame 14 to extend substantially upward from frame central member 80. The upper surfaces of the axle mount supports 22 and 24 are shaped and sized in the form of upwardly concave housings 102 and 104 to receive approximately the lower half of the drive wheels 30 and 32. Concave housings 102 and 104 on the upper surface of the axle supports 22 and 24 contain low friction engaging systems (not shown), such as bearing systems, to allow the drive wheels 30 and 32 to rotate within the concave housings 102 and 104 with little resistance.

Figure 2A:
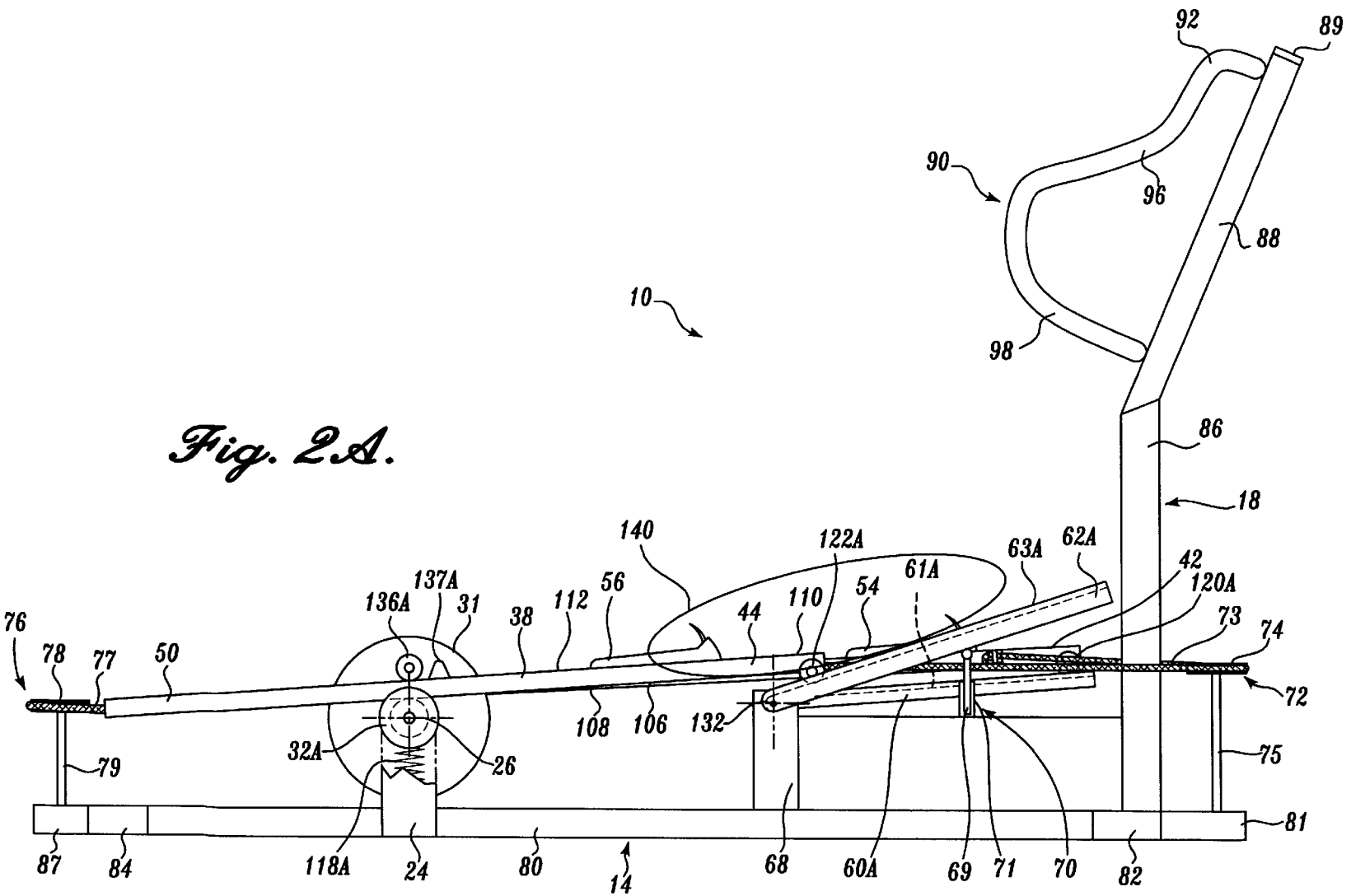
FIG. 2A illustrates a side view of another embodiment of the present invention similar to that shown in FIG. 2 that incorporates shaped pinch/idler rollers and drive wheels, shaped foot links and guide ramps, and a dampened capstan drive.

In the exemplary embodiment shown in FIG. 2A, pinch/idler rollers 134A and 136A extend outwardly from the center housing 31 (which contains a flywheel 27) over the drive wheels 30A and 32A (which are correspondingly spool-shaped) to "capture" the foot link members 36 and 38 between the pinch/idler rollers 134A and 136A and the drive wheels 30A and 32A. These pinch/idler rollers 134A and 136A and spool-shaped drive wheels 30A and 32A act to prevent lateral wobble of the foot link members 36 and 38. Further, stop protrusions 135A and 137A, are located on the upper surfaces of the foot links 36 and 38 which limit the rearward movement of the foot links, thereby preventing the foot links from moving rearward beyond a predetermined point.

Referring again to the exemplary preferred embodiment shown in FIGS. 1 and 2, the transverse axle 26 is bifurcated, such that its left half and right half can rotate independently, in opposite rotational directions of one another. The bifurcation also allows the flexibly coordinated foot link motion produced pulley systems 72 and 76. Each half of the transverse axle 26 connects to the flywheel 27 contained within the center housing 31. Such flywheels are known in the art. Left and right drive wheels 30 and 32 are securably connected to their respective halves of the transverse axle 26. The drive wheels 30 and 32 are capstan-type drives and incorporate one-way clutch systems (not shown) such that greater force is required to rotate the drive wheels 30 and 32 towards the rear of the exerciser 10, than is required to rotate the drive wheels towards the front of the exerciser. Such clutch systems are standard articles of commerce.

The elliptical motion exerciser 10 further contains longitudinally disposed left and right foot link members 36 and 38. The foot link members are illustrated as in the shape of elongated, relatively thin beams. The foot link members 36 and 38 are of a width substantial enough to accommodate the width of an individual's foot. The foot link members 36 and 38 define lower surfaces 106 and 108, and upper surfaces 110 and 112, and are aligned in substantially parallel relationship with the longitudinal central member 80 of the frame 14.

The foot support portions 54 and 56 are positioned on the top surfaces 106 and 108 of the foot link members, near the front ends thereof, and include engagement pads 114 and 116, which provide stable foot placement locations for an individual user. Preferably, the foot support portions 54 and 56 are configured to form toe straps or cups which aid in forward motion recovery at the end of the downward, rearward elliptical drive motion.

In the exemplary preferred embodiment shown in FIGS. 1 and 2, the rear end portions 48 and 50 of the foot link member lower surfaces 106 and 108 rollably engage the top half of the left and right drive wheels 30 and 32, which are exposed from the concave housings 102 and 104. In this manner, the left and right foot link members 36 and 38 engage the left and right drive wheels 30 and 32 as the foot link members reciprocate back and forth, such that the one-way clutch system (not shown) imports a greater resistance as the foot link members 36 and 38 are individually pushed backwards than when the foot link members are pushed forward.

In an exemplary embodiment shown in FIG. 2A, the axle mount supports 22A and 24A are configured to house springs 118A or other biasing mechanisms located under the drive wheels 30 and 32 to help smooth out the path traveled by the foot support portions 54 and 56 by dampening undesirable jarring motions with shock absorbing members such as springs, elastomeric material, etc.

Referring again to the exemplary preferred embodiment shown in FIGS. 1 and 2, left and right rollers 120 and 122 are coupled to the forward end portions 42 and 44 of the foot link members 36 and 38 to extend downwardly of the foot link lower surfaces 106 and 108. The rollers 120 and 122 rollably engage left and right inclinable guide ramps 60 and 62. The guide ramps 60 and 62 are illustrated as being of an elongated, generally rectangular, thin shape, somewhat similar to the configuration of the foot link members 36 and 38. The inclinable guide ramps 60 and 62 are of a width sufficient to support the rollers 120 and 122, and are of a length sufficient to substantially accommodate a full stride of an individual user whose feet are placed on the individual foot engagement pads 114 and 116 of the foot link members 36 and 38.

In an exemplary embodiment shown in FIG. 2A, the inclinable guide ramps 60A and 62A are formed with raised sidewalls 61A and 63A to laterally constrain the rollers 120A and 122A. Lateral movement of the foot link members 36 and 38 could also be constrained by utilizing spool-shaped rollers (not shown) having enlarged diameter rims at their ends to extend over the longitudinal edges of the inclinable guide ramps 60 and 62. In yet another exemplary embodiment, the foot link members 36 and 38 do not contain foot link rollers 120 and 122 but instead utilize sliders (not shown) or some other translational facilitating mechanism for interacting with the inclinable guide ramps 60 and 62.

As most clearly illustrated in FIG. 2, the inclinable guide ramps 60 and 62 pivot about axes 130 and 132 located near the rearward ends of the guide ramps. The inclinable guide ramps 60 and 62 are rotatably secured at their pivot axes 130 and 132 to left and right guide ramp mount supports 66 and 68 that extend upwardly from the frame 14. The inclinable guide ramps 60 and 62 are biased upwardly (in a counter-clockwise direction when viewed from the right side of the exerciser 10 as shown in FIG. 2), by a ramp return assembly 70. The return assembly 70, includes a pivot arm 69 that engages the underside of each inclinable guide ramp 60 and 62, and is coupled to a mounting structure 78 at a central pivot axis 71, such that when one of the inclinable guide ramps pivots downwardly the return assembly 70 forces the other inclinable guide ramp to pivot upwardly in teeter-totter fashion. Thus, the return assembly 70 provides corresponding reciprocal motion between the inclinable guide ramps 60 and 62 in response to the alternating downward forces incurred from the striding motion of an individual user via the rollably connected foot link members 36 and 38.

The exerciser 10 further includes forward and rearward pulley and belt systems 72 and 76, which provide the flexibly coordinated motion between the foot links 36 and 38. The belts 73 and 77 of the systems 72 and 76 are stretchable, which produces the flexible aspect of the coordinated foot link motion. In the forward pulley and belt system 72, the belt 73 is attached to the forward ends 42 and 44 of the foot links 36 and 38, and loops over the front portion of a rotatable, generally horizontal pulley 74, such that when one of the foot links moves rearward, the pulley and belt system 72 causes the other foot link to move forward (in flexible coordinated or substantially related motion). In the rearward pulley and belt system 76, the belt 77 is attached to the rearward ends 48 and 50 of the foot links 36 and 38, and loops over the rear portion of a rotatable, generally horizontal pulley 78, such that when one of the foot links moves forward the pulley and belt system 76 causes the other foot link to move rearward (in flexible coordinated or substantially related motion). Further, the belts 73 and 77 can be selected in varying degrees of flexibility or stretchability, and in this manner the degree of flexibility in the coordinated motion can be varied or modified as desired.

As most clearly shown in FIG. 1, the forward pulley 74 is rotatably mounted on the upper end of a hub 75 by a gimbal 75*a*. The hub extends upwardly from the front transverse member 82 of the frame 14. Likewise, the rearward pulley 78 is rotatably mounted on the upper end of a hub 79 by a gimbal 79A. Also, the hub 79 extends upwardly from the rear transverse member 84 of the frame 14. The gimbals allow the pulleys 74 and 78 to tilt as the angle or slope of the belts 73 and 77 change in response to the fore and aft positions of the foot links 36 and 38. The connection of each pulley 74 and 78 to its respective hub 75 and 79 preferably allows for not only planar rotation, but also for at least some degree of spherical rotation, such as that provided by a globoidal cam and oscillating follower type system, to allow the self-alignment of the pulley 74 and 78 in response to the multi-directional forces incurred from engagement of the belts 73 and 77. Preferably, the pulleys 74 and 78 also each include at least partial housing covers, (shown in FIG. 2), configured to help prevent the belts 73 and 77 from dislocating from the pulley wheel 74 and 78 during operation of the exerciser 10, as well as preventing a user's hands or feet from being pinched between the belts 73 and 77 and the pulley wheels 74 and 78.

To use the present invention, the user stands on the foot support portions 54 and 56. The user imparts a rearward stepping action on one of the foot supports and a forward motion on the other foot support portion, thereby causing the left and right drive wheels 30 and 32 to rotate in opposite directions about their respective halves of the transverse axle 26. As a result, the rear end portions 48 and 50 of the foot link members 36 and 38 rollably engage the drive wheels 30 and 32 while the forward end portions 42 and 44 of the foot link members sequentially ride up and down the inclinable guide ramps 60 and 62. The pivot arm 69 of the return assembly 70 oscillates back and forth about its pivot axis 71, forcing one of the guide ramps upward in response to downward motion incurred from the other guide. The pulley and belt systems 72 and 76 induce flexibly coordinated motion, such that when one of the foot links moves forward the pulley and belt systems 72 and 76 force the other foot link to move in rearward (a substantially related amount due to the stretchable belts 73 and 77), and vice versa. The stretchable belts 73 and 77 result in the pulley systems 72 and 76 producing flexibly coordinated motion, in that the belts allow a certain amount (depending upon the degree of stretchability) of uncoordinated motion between the two foot links 36 and 38. However, the belts 73 and 77 could also be substantially inflexible without departing from the scope of the present invention.

The forward end of each foot link member sequentially travels downwardly and rearwardly along its corresponding inclinable guide ramp as the rear end of that foot link member moves from the link's forwardmost location (the maximum extended position of the foot link) to the link's rearwardmost location (the maximum retracted position of the foot link). From this maximum retracted position of the foot link, the user then imparts a forward stepping motion on the foot support which rotates the corresponding drive wheel in the reverse direction (clockwise as viewed from FIG. 2) and causes the foot link member to travel back upwardly and forwardly along its corresponding inclinable guide ramp back to the maximum extended position of the foot link. As shown in FIG. 2, the path of travel drawn out by the foot supports is basically in the shape of a forwardly and upwardly tilted ellipse 140.

The interaction of the oscillating weight of a user produced by typical running, jogging or walking motion, with the upwardly biased resistance of the individual inclinable guide ramps 60 and 62, combine to produce a highly desirable bi-pedal variable, flexibly coordinated elliptical motion. To further explain this effect, analysis of typical bi-pedal motion such as that produced by running, jogging or walking is required. During the cycle created by a striding motion, maximum upward force is generated when an individual's foot is approximately at its furthest rearmost position. This upward force decreases as a striding individual's foot approaches the cycle's apex near the midpoint of the stride and then begins transitioning into downward force as the foot continues forward. Maximum downward force is produced when a striding individual's foot is approximately at its forwardmost point in the cycle. This downward force in turn diminishes as the striding individual's foot approaches the midpoint of the cycle's lower path of travel. Completing the cycle, the upward force produced by the striding motion then increases until the force reaches its maximum at approximately the rearmost point of the cycle's path of travel.

Additionally, due to the rotational pivoting connection of the upwardly biased inclinable guide ramps 60 and 62, a torque lever arm is created. Thus, downward force applied to the inclinable guide ramps 60 and 62 imports a proportionally greater magnitude of rotational force onto the guide ramps, the further forward towards the non-pivoting end of the guide ramps, that the force is applied. The interaction of the force gradients produced during the cycle of a striding individual's path of travel, with the varying upwardly biased resistance produced by a individual user's path of travel along the length of the torque lever arm (guide ramp), results in a desirable variable, flexibly coordinated elliptical motion, the exact parameters of which are determined by the forces input by an individual user.

Figure 3:
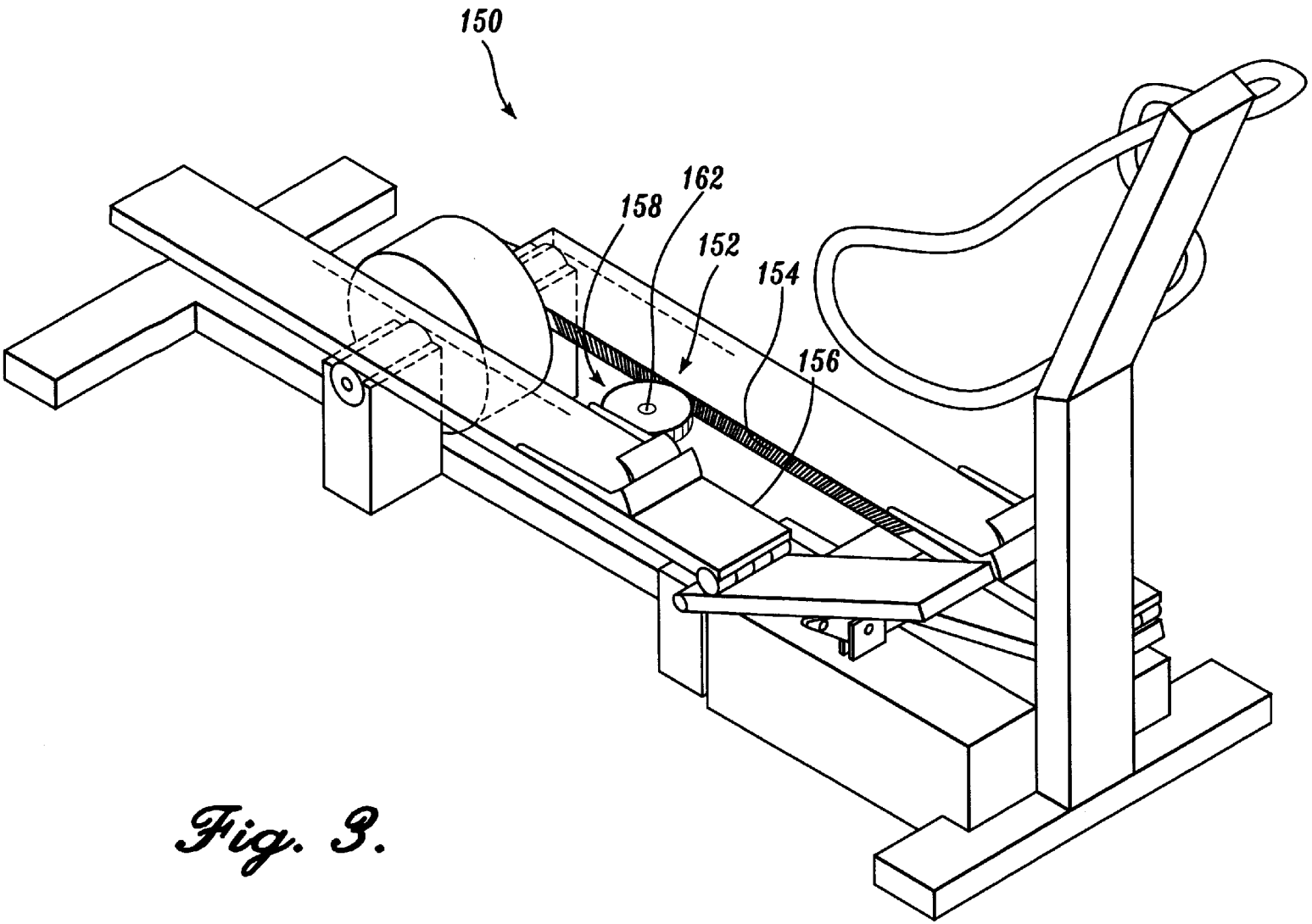
FIG. 3 illustrates a perspective view of an alternate embodiment of the present invention, utilizing teeter-totter type guide ramp returns that is flexibly coordinated by rack and pinion system.
Figure 4:
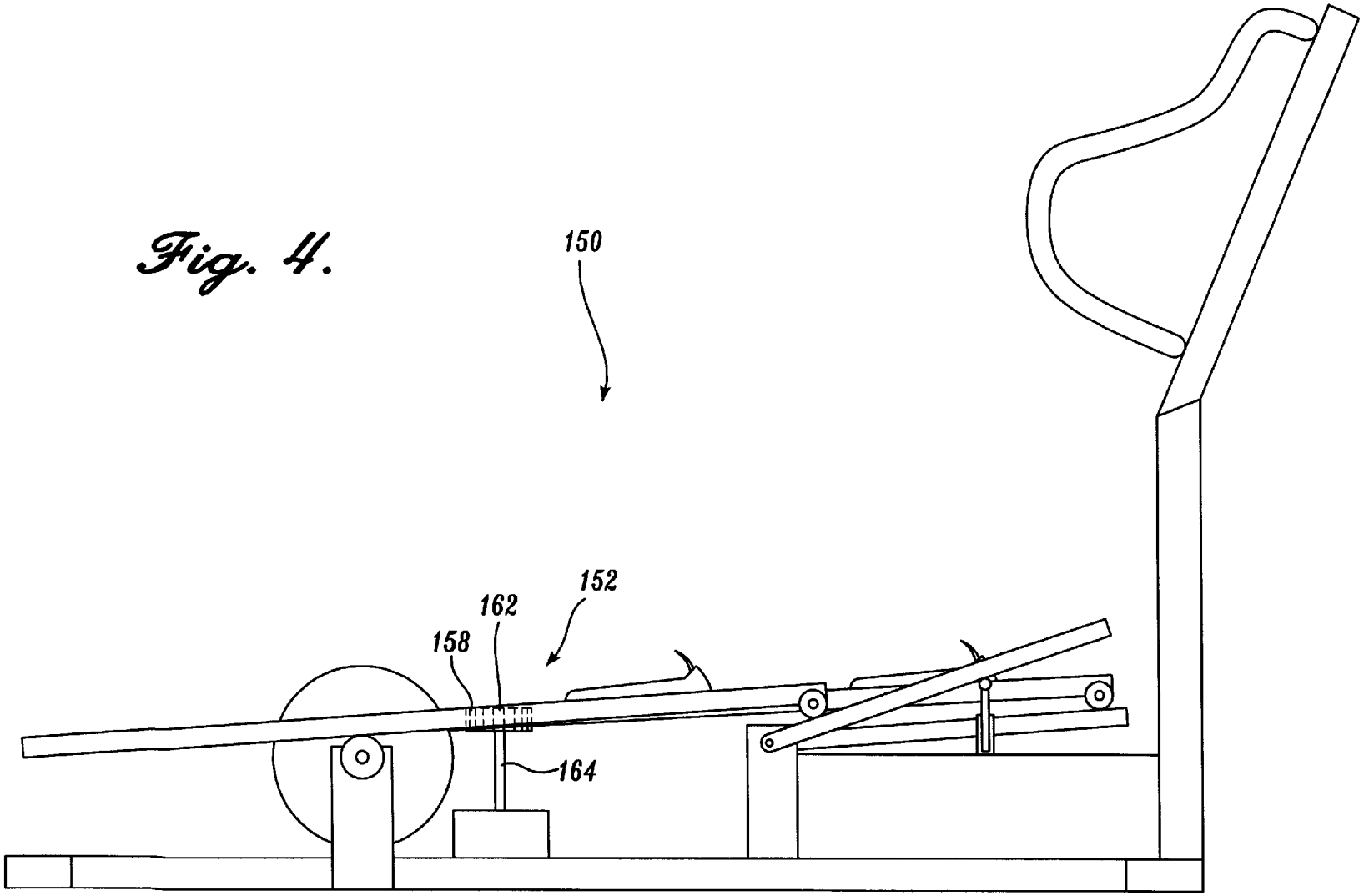
FIG. 4 illustrates a side elevation view of the embodiment of the present invention shown in FIG. 3.

FIGS. 3 and 4 illustrate another preferred embodiment of a flexibly coordinated elliptical motion exerciser 150 constructed in accordance with the present invention. The exerciser 150 shown in FIGS. 3 and 4 is constructed and functions similarly to the exerciser 10 shown in the prior figures. Accordingly, the exerciser 150 will be described only with respect to those components that differ from the components of the exerciser 10. The exerciser 150 does not contain forward and rearward pulley and belt systems 72 and 76, but instead utilizes a by rack and pinion system 152 that is preferably flexibly coordinated through the implementation of a variable draw, in order to provide flexibly coordinated motion between the foot links 36 and 38.

Left and right racks 154 and 156 are located on the inner edges of the foot link members 36 and 38. Further, as shown in FIG. 3, the racks 154 and 156 can have a non-typical (varying angled) profile to help facilitate proper tracking by allowing for rise and fall of the foot links 36 and 38 on the guide ramps 36 and 38. A pinion 158 is located between the foot link members 36 and 38, and is attached to the longitudinal central member 80 of the frame 14 by a globoidal cam type system 162 mounted on a hub 164. The globoidal cam type system 162 provides a sufficient amount of spherical rotation to allow the pinion mechanism 156 to properly follow the oscillating motion of the racks 152 and 154 on their respective foot links 36 and 38.

The racks 154 and 156 and/or the pinion 158 of the system 152 can be constructed from a flexible material or can be arranged in a stretchable configuration that permits a flexible draw (i.e. the draws of the rack mechanism 154 and 156 are permitted to be slightly unequal to or uncoordinated with each other). This allows the foot links to be flexibly coordinated in substantially related motion, in contrast to forced one-to-one coordinated motion. However, the rack and pinion system 152 could also contain rack 154 and 156 and pinions 158 that are substantially inflexible without departing from the scope of the present invention.

Figure 5:
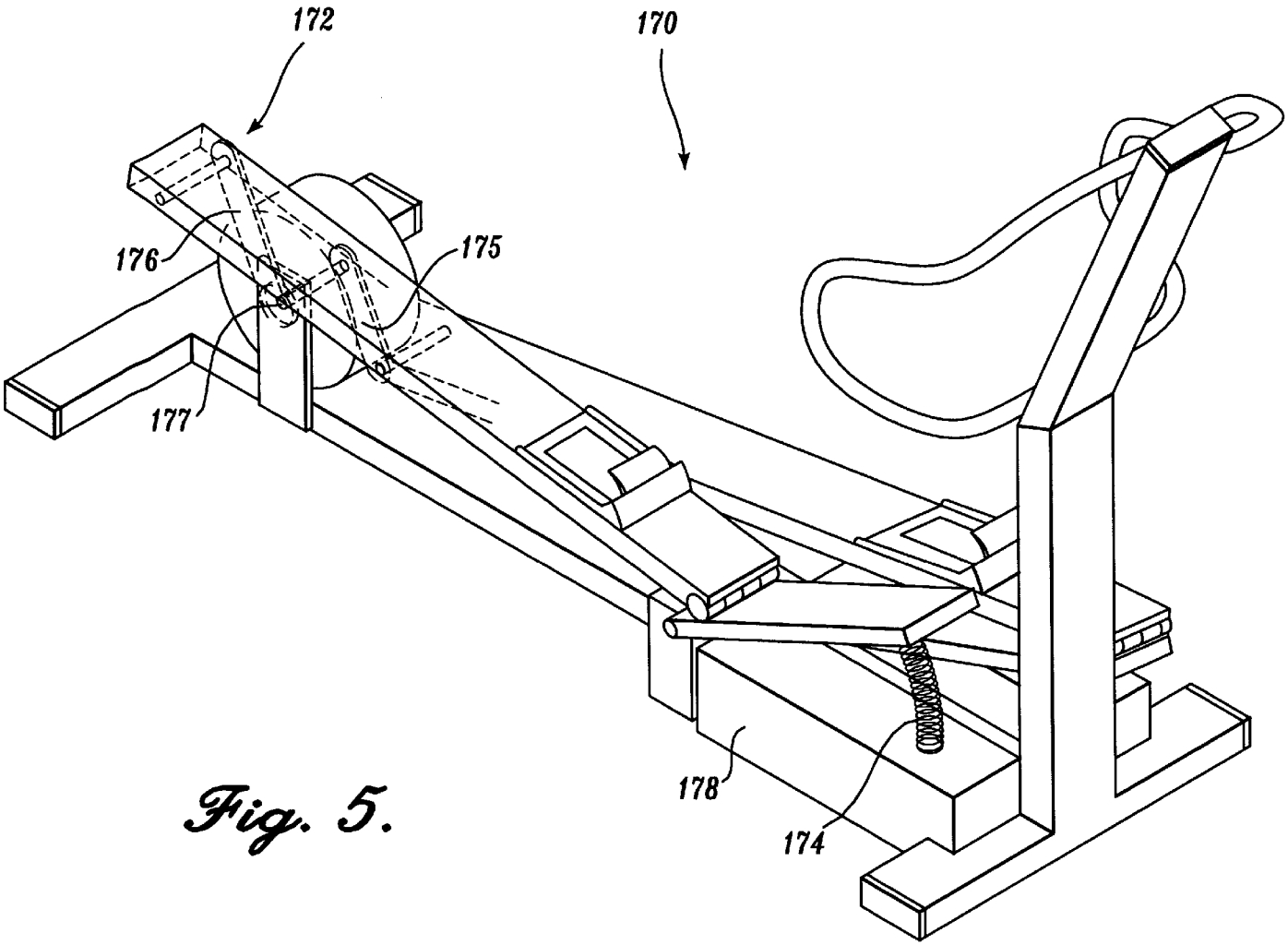
FIG. 5 illustrates a perspective view of an alternate embodiment of the present invention, utilizing spring biased ramp returns that are flexibly coordinated by an axle and crank arm assemblies.
Figure 6:
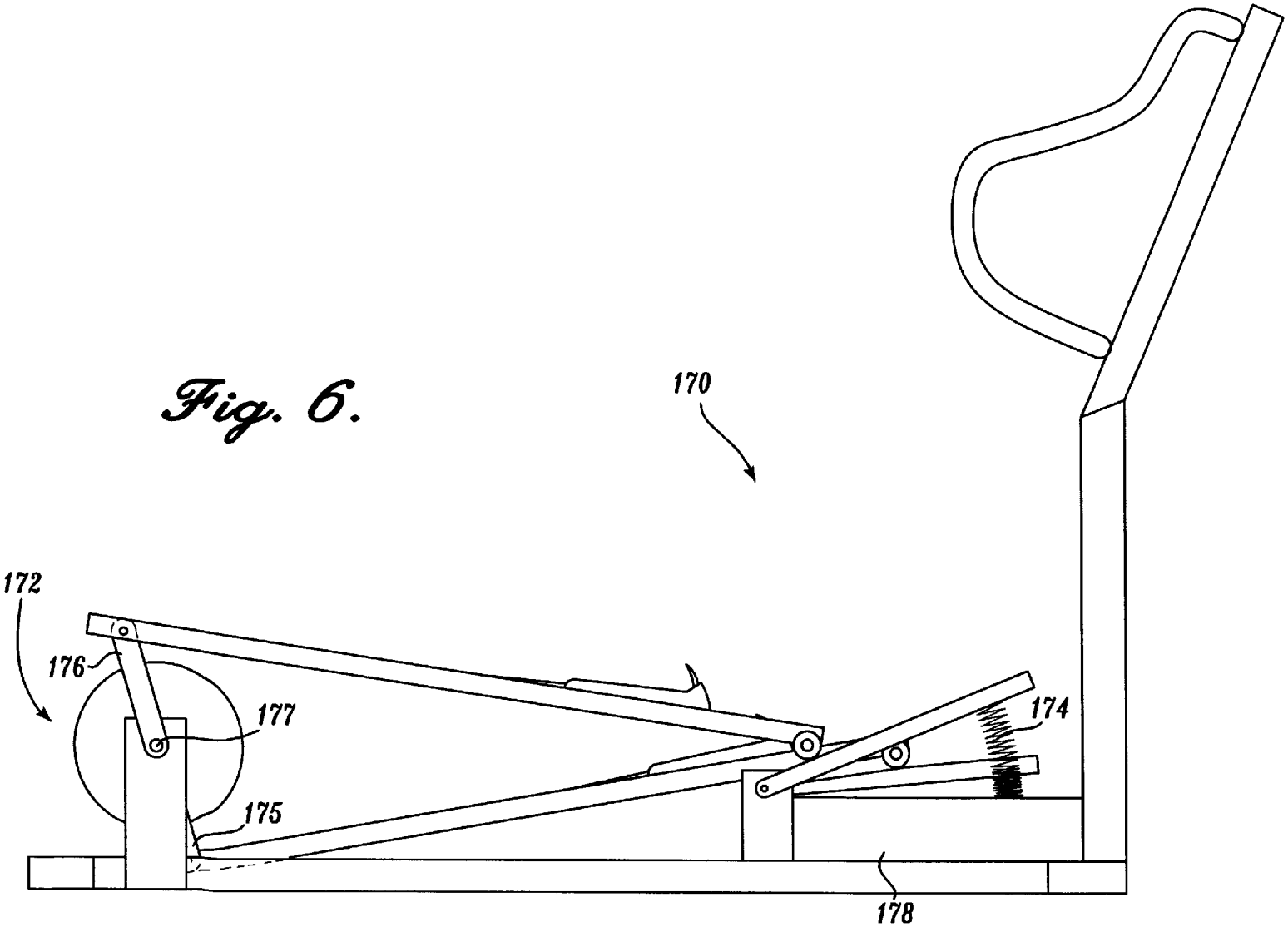
FIG. 6 illustrates a side elevation view of the embodiment of the present invention shown in FIG. 5.

FIGS. 5 and 6 illustrate yet another preferred embodiment of a flexibly coordinated elliptical motion exerciser 170 constructed in accordance with the present invention. The exerciser 170 shown in FIGS. 5 and 6 is constructed and functions similarly to the exercisers 10 and 150 shown in FIGS. 1–4. Accordingly, the exerciser 170 will be described only with respect to those components that differ from the components of the exercisers 10 and 150. The exerciser 170 does not contain a transverse pivot arm return assembly 70, but instead utilizes springs 174 or other biasing members to resist downward forces applied to the inclinable guide ramps 60 and 62. The lower ends of the springs 174 are secured to a biasing member mounting structure 178 that is in turn attached to the frame 14. Additionally, it is appreciated that any number of different biasing members could be used to provide resistance to the inclinable guide ramps such as air springs, isometric cones, pneumatic pressure systems, hydraulic pressure systems, etc.

Further, the exerciser 170 also differs from the exercisers 10 and 150 in that the exerciser 170 does not contain either forward and rearward pulley and belt systems 72 and 76, or a rack and pinion system 152, but instead utilizes a rotational crank arm assembly 172 that is preferably joined by a partially bifurcated transverse axle 177 (described in detail below) which provide flexible coordinated motion between the foot links 36 and 38. As shown in FIGS. 5 and 6, the exerciser 170 also does not contain drive wheels 30 and 32, concave housings 102 and 104, or a bifurcated transverse axle 26, but instead utilizes left and right rotational crank arms 175 and 176 which connect the rear end portions 48 and 50 of the left and right foot link members 36 and 38 via a partially bifurcated transverse axle 177. Unlike previous embodiments of the present invention that utilized a two-piece transverse axle 26 which was completely bifurcated (in order to allow the foot links 36 and 38 to move in substantially opposite directions), the exerciser 170 utilizes a partially bifurcated transverse axle 177 which allows the foot links to move in substantially related, flexibly coordinated motion, in contrast to the forced one-to-one coordinated motion produced by a solid one-piece axle. The left and right end sections of the partially bifurcated transverse axle 177 are joined in the center by a member that translates force from one end section of the partially bifurcated transverse axle to the other in a flexible manner, such as a spring, elastomeric unit, etc. However, the exerciser 170 could utilize a one-piece transverse axle without departing from the scope of the present invention.

The coupling of the rear end portions 48 and 50 of the foot links 36 and 38 to the transverse axle 26 by the crank arms 175 and 176, causes the rotational path of the rear end portions 48 and 50 to rise and fall a much larger distance than in the previously described embodiments. Thus, this preferred embodiment exerciser 170 produces a significantly different shaped elliptical path of travel, since the rear end portions 48 and 50 of the foot link members 36 and 38 substantially rise and fall, as well as the front end portions 42 and 44 of the foot link members 36 and 38 which also rise and fall as they travel up and down the inclinable guide ramps 60 and 62. The distance that the rear end portions 48 and 50 of the foot link members 36 and 38 rise and fall is proportional to the length of the crank arms 175 and 176. In alternate preferred embodiments of the present invention, left and right crank arm assemblies employing multiple operatively connected parts could be utilized in place of the crank arms 175 and 176, without departing from the scope of the present invention. These various crank arm assembly configurations could also be used to or result in alteration of the shape of the ellipse drawn out by the foot link members 36 and 38.

Figure 6A:
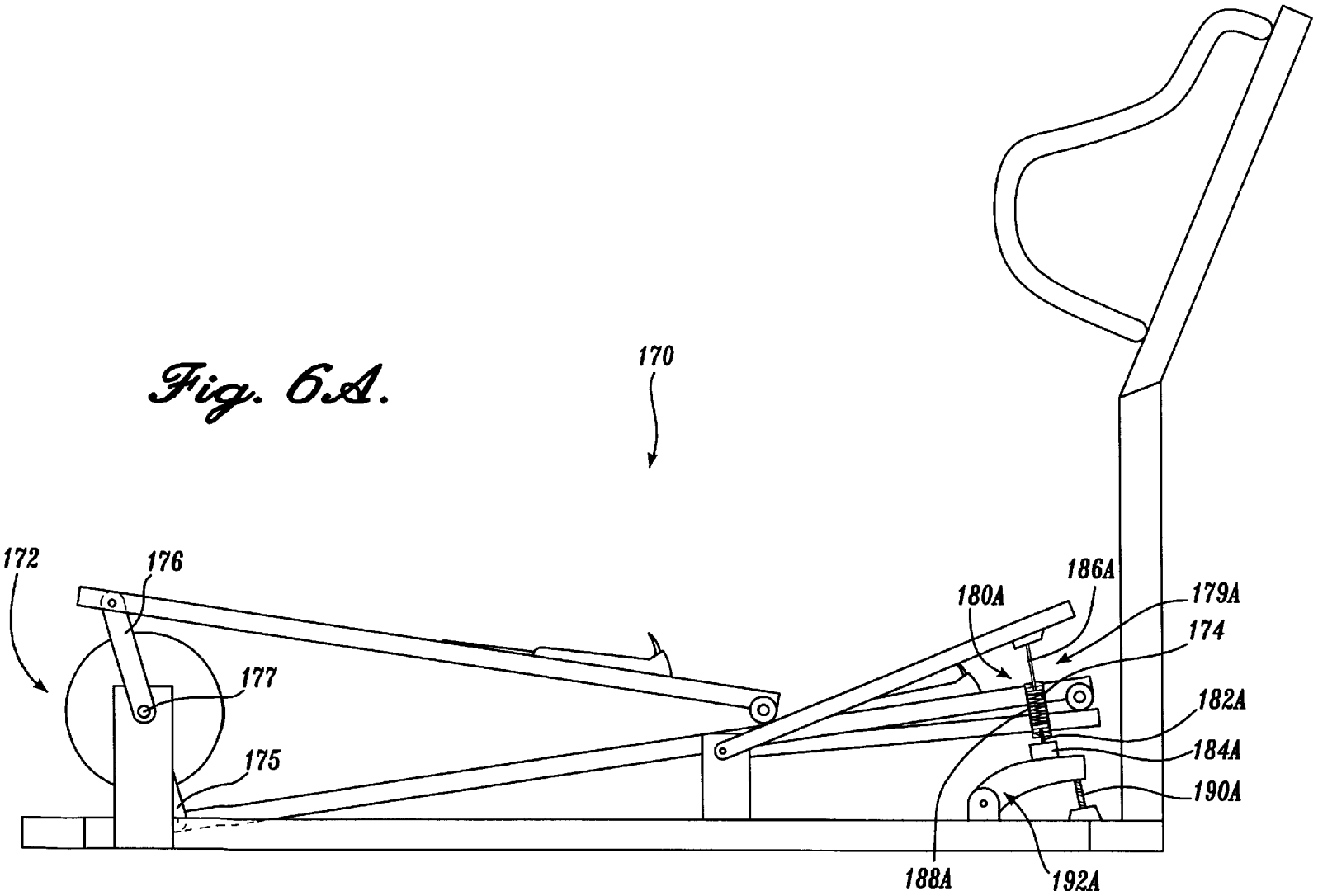
FIG. 6A illustrates a side elevation view of another embodiment of the present invention similar to that shown in FIG. 6 that incorporates guide ramp resilience adjusting mechanisms, and guide ramp position adjusting mount supports.

Referring to FIG. 6A, the left and right biasing members 174 ideally employ adjustable resistance biasing mechanisms 179A for selecting a desirable level of resistance imposed by the biasing members 174 against the downward forces of the inclinable guide ramps 60A and 62A. Adjustable resistance biasing mechanisms 179A can be used to compensate for variations in the body weight of the user, as well as to alter the parameters of the elliptical path traveled by the user's feet.

The adjustable resistance biasing mechanisms 179A, shown in FIG. 6A, utilize a variable resistance spring assembly 180A to allow the resistance level opposing the downward forces (imposed by the inclinable guide ramps 60A and 62A) to be adjusted. The resistance level produced by the spring is varied by preloading the spring 174 with a lead screw 182A and motor 184A against an opposing plunger 186A within the spring cylinder 188A. The opposing plunger is driven downwardly by the user's weight on the foot links via the guide ramps (as shown in FIG. 6A). Numerous other types of adjustable resistance biasing members could also be utilized. These include adjustable resistance air springs which can be set at varying air pressures, and adjustable resistance fluid springs which can alter a value size through which the fluid in the spring must be forced. Further, biasing level adjustments could be achieved by adding or subtracting the number of springs or biasing members utilized.

Preferred embodiments of the above-described variations of the present invention ideally, but not essentially, also include a lift mechanism 190A (as shown in FIG. 6A) for adjusting the angle of inclination of the ellipse traced out by the foot link members 36 and 38 within the exerciser 170A. The exemplary lift mechanism 190A rotates the biasing member mounting structure 178A (upon which the spring members 174, other biasing members, or transverse pivot-arm ramp return assembly 70 are mounted) about pivot mount 192A, thus raising or lowering the location on the mounting structure 178A at which the spring members 174 are secured. This allows the individual user of the exerciser 170A to customize the level of difficulty of the exercise and the muscle groups that are focused upon. Different lift mechanisms could also be used to accomplish this purpose that are known in the art. For example, another lift system could be employed that raised and lowered the forward end portion of the frame 14.

Another alternate embodiment of the present invention could utilize spring positioning adjustment tracks, not shown, which would allow the location of the springs to be adjusted along the length of the inclinable guide ramps 60A and 62A and the mounting structure 178A, either closer or further away from their respective pivot axes 130 and 132. This would alter the resistance imported onto the inclinable guide ramps 60A and 62A by changing the position of the force distribution along the torque lever arm created by guide ramps 60A and 62A.

Figure 7:
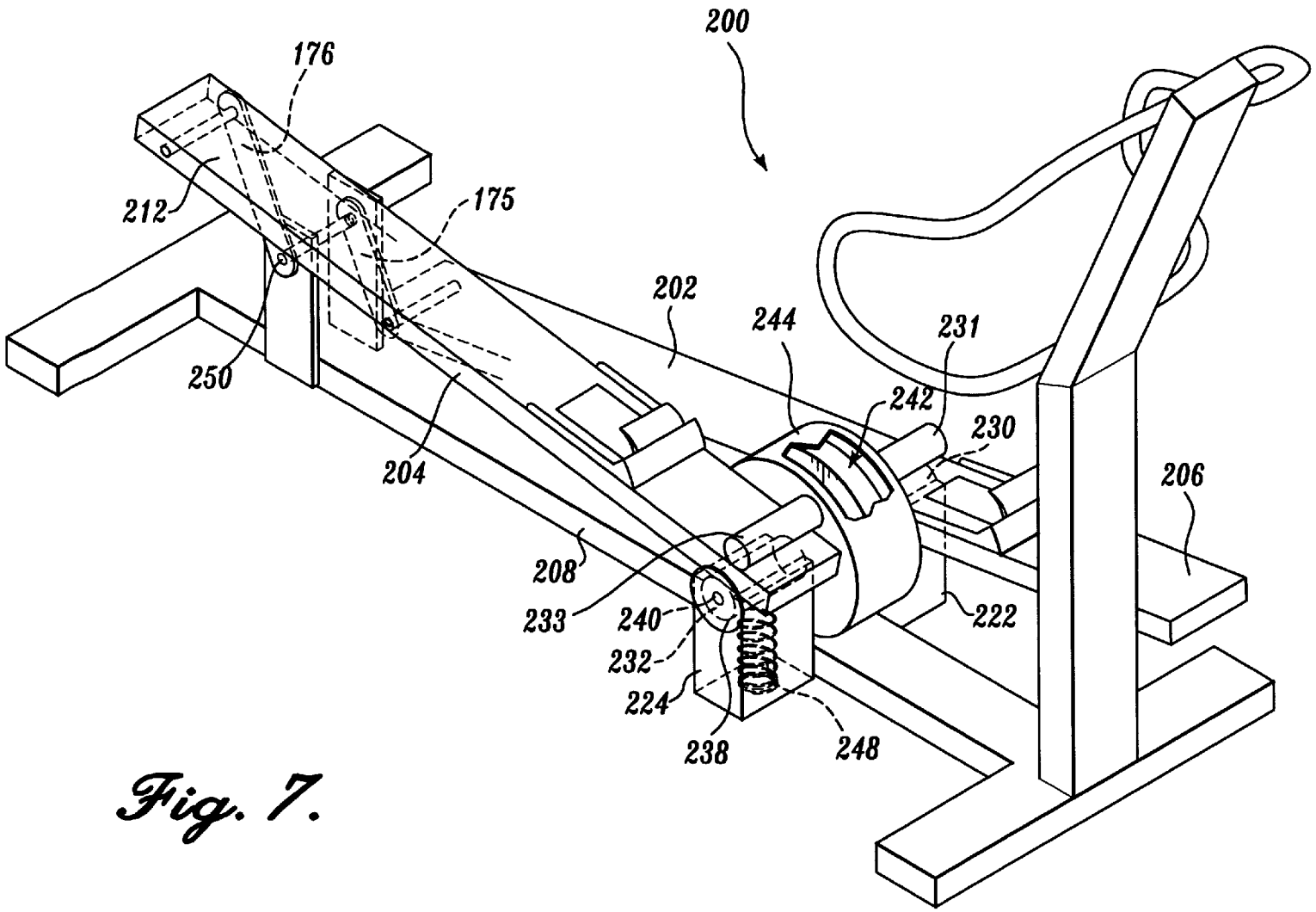
FIG. 7 illustrates a perspective view of an alternate embodiment of the present invention, utilizing a flexibly coordinated axle and crank arm assembly and a capstan drive dampened by biasing resilient members.
Figure 8:
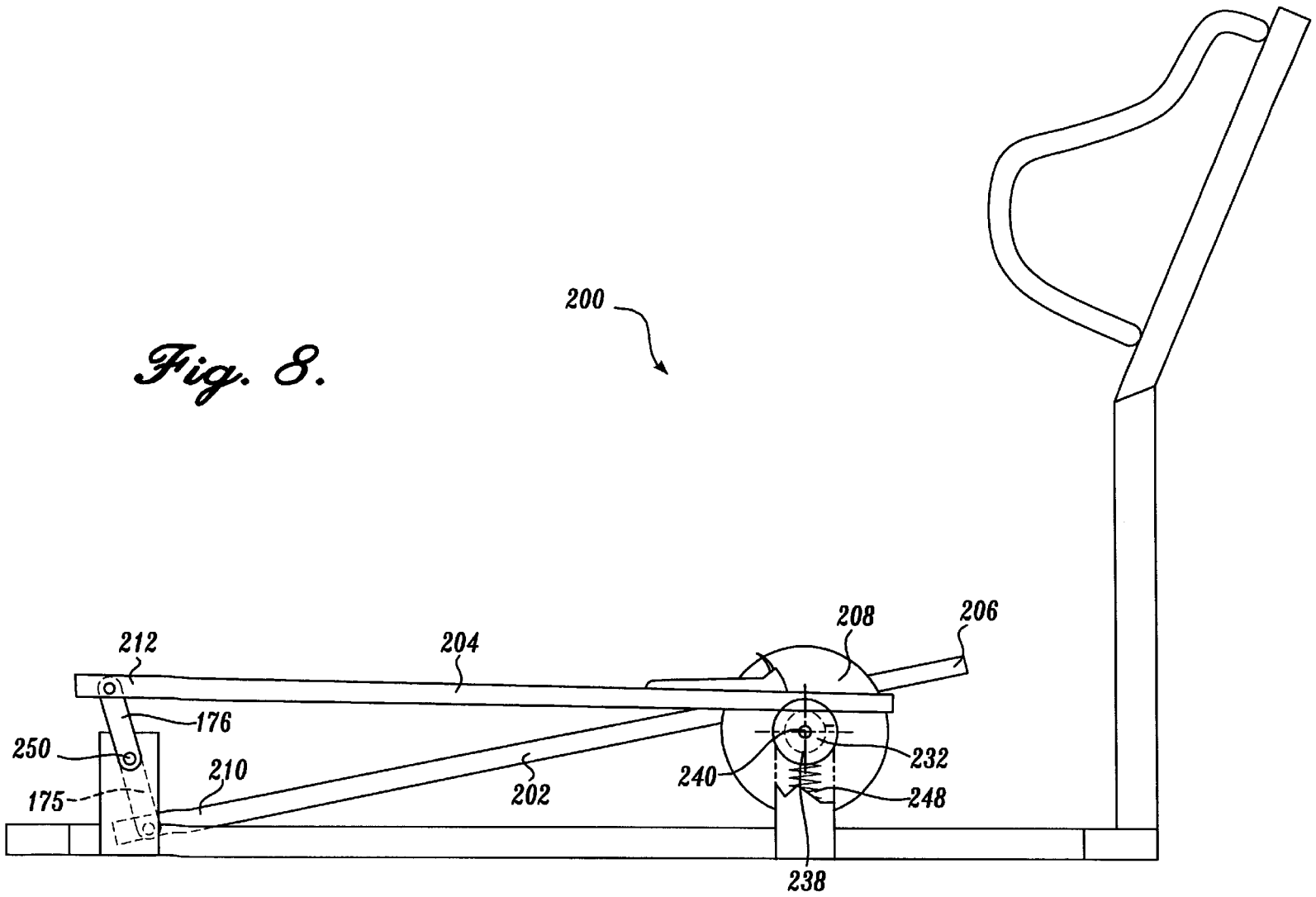
FIG. 8 illustrates a side elevation view of the embodiment of the present invention shown in FIG. 7.

FIGS. 7 and 8 illustrate still another preferred embodiment of a flexibly coordinated elliptical motion exerciser 200 constructed in accordance with the present invention. The exerciser 200 shown in FIGS. 7 and 8 is constructed and functions similarly to the exercisers 10, 150 and 170 shown in FIGS. 1–6. Accordingly, the exerciser 200 will be described only with respect to those components that differ from the components of the exercisers 10, 150 and 170. The forward region of exerciser 200 does not contain inclinable guide ramps 60 and 62, guide ramp mount supports 66 and 68, a transverse pivot arm ramp return assembly 70, spring biasing mechanisms 174, biasing member mounting structures 178, or rollers 120 and 122 on the forward end portions 42 and 44 of the foot link members 36 and 38. Instead, the forward region of exerciser 200 employs mechanisms for engaging the left and right forward end portions 206 and 208 of the left and right foot link members 202 and 204 that are virtually identical to previously described mechanisms used to engage the rear end portions 48 and 50 of the foot link members 36 and 38 (as shown in FIGS. 1–4 for exercisers 10 and 150).

Specifically, the left and right axle mount supports 22 and 24, left and right drive wheels 30 and 32, left and right concave housings 102 and 104, the bifurcated transverse axle 26, the flywheel 27, and the center housing 31 (which are used to engage the rear end portions 48 and 50 of the foot link members 36 and 38 in exercisers 10 and 150, shown in FIGS. 1–4) are replaced by left and right forward axle mount supports 222 and 224 having upper surfaces with concave housings 236 and 238, left and right forward drive wheels 230 and 232, and a forward bifurcated transverse axle 240 which connects to a forward flywheel 242 contained within a forward center housing 244 (for engaging the left and right forward end portions 206 and 208 of the left and right foot link members 202 and 204 in the exerciser 200, as shown in FIGS. 7 and 8). All of these aforementioned parts for engaging the forward end portion 206 and 208 of the foot link members 202 and 204 in the exerciser 200 function in the same manner as their previously described for rear counterparts which engage the rear end portions 48 and 50 of the foot link members 36 and 38 in exercisers 10 and 150.

The exerciser 200 does differ from the previously described exercisers however, in that the forward axle mount supports 222 and 224 contain biasing dampening systems 248 (similar to the biasing mechanisms 118A shown in FIG. 2A) to inhibit undesirable jarring motions with shock absorbing devices such as springs, elastomeric members, etc. In a preferred embodiment, the exerciser 200 is also similar to the embodiment shown in FIG. 2A, in that pinch/idler rollers 23 1A and 233A extend outwardly from the forward center housing 244 (which contains the forward flywheel 242) over the drive wheels 230A and 232A (which are correspondingly spool-shaped) to "capture" the foot link members 202 and 204 between the pinch/idler rollers 23 1A and 233A and the drive wheels 230A and 232A. These pinch/idler rollers 231A and 233A and spool-shaped drive wheels 230A and 232A act to prevent lateral wobble of the foot link members 202 and 204.

Further, the exerciser 200 also differs from the previously described preferred embodiment exercisers in that the exerciser 200 does not contain some of the mechanisms utilized in the previous embodiments that are associated with engaging the rear end portions 210 and 212 of the foot link members 202 and 204. In this respect, the exerciser 200 (shown in FIGS. 7 and 8), is most similar to the exerciser 170 (shown in FIGS. 5 and 6). Referring again to FIGS. 7 and 8, the exerciser 200 contains a rotational crank arm assembly 172 that is preferably joined by a rear partially bifurcated transverse axle 250 (same as the partially bifurcated transverse axle 177 described above) which provide flexible coordinated motion between the foot links 36 and 38. The left and right rotational crank arms 175 and 176 connect the rear end portions 210 and 212 of the foot link members 202 and 204 to the rear transverse bifurcated axle 250. Thus, the exerciser 200 actually contains a front completely bifurcated transverse axle 240 and a rear partially bifurcated transverse axle 250.

The exerciser 200 differs from the exerciser 170, however, in that the exerciser 200 does not contain a rear flywheel or central housing, which are unnecessary since a forward flywheel 242 and a forward central housing 244 already exist in the front region of the exerciser. In an alternate embodiment exerciser, the forward flywheel 242 and the forward central housing 244 could be replaced by a rear flywheel (not shown) and a rear central housing (not shown) without departing from the scope of the present invention. Further, in another embodiment the exerciser 200 could utilize either a solid or completely bifurcated rear transverse axle instead of the partially bifurcated rear transverse axle 250.

As in the exerciser 170, the rotational crank arms 175 and 176 cause the rotational path of the rear end portions 210 and 212 of the foot link members 202 and 204 in the exerciser 200 to rise and fall a substantial distance. Unlike the first three embodiments 10, 150, and 170, however, the exerciser 200 does not contain inclinable guide ramps 60 and 62 to cause the rise and fall of the forward end portions 206 and 208 of the foot link members 202 and 204. However, as previously mentioned, the forward axle mount supports 222 and 224 contain biasing dampening systems 248 which do produce some limited degree of rise and fall motion. Thus, this preferred embodiment exerciser 200 produces a significantly differently shaped elliptical path of travel than that of the previous embodiments. The shape of this ellipse can be modified by changing the length of the crank arms 175 and 176. Further, the exerciser 200 is also subject to the same above-described structural variations to obtain the same above-described alternate preferred embodiment characteristics as for exercisers 10, 150, and 170.

Additionally, preferred embodiments of all of the above-described variations of the present invention ideally, but not essentially further include a mechanism (not shown) for adjusting the resistance level produced by the one-way clutch of the drive wheel 30 and 32. Resistance adjustment devices are well known in the art and any of the variety of known methods may be utilized. The addition of a resistance adjustment device allows the individual user of the exerciser 10 to customize the level of difficulty of the exercise.

The present invention has been described in relation to a preferred embodiment and several preferred alternate embodiments. One of ordinary skill after reading the foregoing specification, may be able to effect various other changes, alterations, and substitutions or equivalents without departing from the concepts disclosed. It is therefore intended that the scope of the letters patent granted hereon be limited only by the definitions contained in the appended claims and equivalents thereof.

The embodiments of the invention in which an exclusive property or privilege is claimed are defined as follows:

1. An exercise device, comprising:

a frame having a forward end portion, a rearward end portion and a transverse axis defined relative to the frame;

a first and second foot link, each foot link including a first end portion, a second end portion and a foot support portion therebetween, each said foot link being operatively associated with the transverse axis such that the foot support portion of each foot link travels in a reciprocal path;

a flexibly coordinating mechanism that substantially relates the movement of the first and second foot links to each other, while permitting some degree of uncoordinated motion between the foot links; and first and second elevation adjustment devices connected to the frame for directing the first end portions of the foot links in flexibly coordinated, reciprocal travel along the length of their respective elevation adjustment devices, the first and second elevation adjustment devices being operatively associated with the first end portions of said first and second foot links, respectively, such that the heights of the elevation adjustment devices are related to the positions of the first end portions of the foot links along the respective elevation adjustment devices.

2. The exercise device of claim 1, wherein the elevation adjustment devices comprise guide ramps that are pivotally connected to the frame.

3. The exercise device of claim 2, wherein the foot links are rollably associated with the transverse axis.

4. The exercise device of claim 2, wherein the guide ramps are linked together by a pivoting assembly that causes one ramp to pivot downwardly as the other ramp pivots upwardly in response to downward forces incurred from the operatively associated foot links.

5. The exercise device of claim 4, wherein the guide ramps are linked together by a transverse pivot-arm ramp return having a central pivot axis that causes one ramp to pivot downwardly as the other ramp pivots upwardly in response to downward forces incurred from the operatively associated foot links.

6. The exercise device of claim 5, wherein the foot links are connected to each other by at least one pulley and belt system that urges one foot link to translate towards one end of the frame as the other foot link translates towards the other end of the frame.

7. The exercise device of claim 6, wherein the belt of the pulley and belt system is flexible, allowing the foot links to be flexibly coordinated in substantially related movement.

8. The exercise device of claim 4, wherein the foot links are connected to each other by a rack and pinion system that causes one foot link to translate towards one end of the frame as the other foot link translates towards other end of the frame.

9. The exercise device of claim 8, wherein the rack and pinion system has a flexible draw that allows the foot links to be flexibly coordinated in substantially related movement.

10. The exercise device of claim 2, further comprising resilient members that bias the guide ramps upwardly against downward forces incurred from the operatively associated foot links.

11. The exercise device of claim 10, further comprising adjustable resistance biasing members that are operatively associated with the resilient members, whereby the degree to which the adjustable resistance biasing members bias the guide ramps upwardly can be altered.

12. The exercise device of claim 10, further comprising a resilient member lift mechanism for adjusting the elevation of the resilient members, and thereby adjusting the angular inclination of the reciprocal path traveled by the foot support portions.

13. The exercise device of claim 10, wherein the resilient members comprise springs that bias the guide ramps upwardly against downward forces incurred from the operatively associated foot links.

14. The exercise device of claim 2, wherein the foot links are operatively connected to the transverse axis by rotational crank arms.

15. The exercise device of claim 14, wherein the rotational crank arms move in flexibly related coordinated motion.

16. The exercise device of claim 2, wherein the operative association of the foot links with the guide ramps acts to vary the angular orientation of the foot links relative to the frame.

17. The exercise device of claim 2, wherein the foot links rollably engage the guide ramps.

18. The exercise device of claim 17, wherein the guide ramps and corresponding rollably engageable foot links are shaped and sized in a configuration that facilitates the lateral containment of the rollably engageable foot links by the guide ramps.

19. The exercise device of claim 2, further comprising a flywheel operatively connected to the transverse axis, said flywheel located at approximately the midpoint of the transverse axis.

20. The exercise device of claim 2, wherein the second end portions of the foot links are operatively associated to a capstan type drive located at the transverse axis.

21. The exercise device of claim 20, wherein resilient members operatively connect the capstan type drive to the frame, thereby dampening the motion of the rollably associated foot links on the transverse axis as the foot support portion of each foot link travels in a reciprocal path.

22. The exercise device of claim 20, wherein the device further comprises:

(a) a center housing located at approximately the midpoint of the transverse axis, whereby the center housing is capable of enclosing a flywheel; and (b) pinch/idler rollers extending outwardly from the center housing above the transverse axis to rollably engage the foot links.

23. The exercise device of claim 22, wherein the capstan type drive is configured to form spool-shaped drive wheels, and the pinch/idler rollers and the spool-shaped drive wheels are positioned to act in conjunction with each other to capture a corresponding foot link therebetween and thus, provide lateral retention of the foot links.

24. The exercise device of claim 2, wherein the second end portions of the foot links are operatively associated with a one-way clutch by way of the transverse axis.

25. The exercise device of claim 24, wherein the one-way clutch imports a greater resistance when the foot support portions of the foot links move from a forward to the rearward position than in moving from a rearward to a forward position.

26. The exercise device of claim 24, wherein the level of resistance imported by the one-way clutch is adjustable.

27. An exercise device, comprising:

a frame having a transverse axle defined thereon, the frame configured to be supported on a floor;

a first and second foot link, each foot link including a first end portion, a second end portion and a foot support portion therebetween, each said foot link being rollably associated with the transverse axle such that the foot support portion of each foot link travels in a flexibly coordinated, reciprocal path;

a drive system operatively associated with each foot link by way of the transverse axle which rollably contacts each foot link such that the foot support portion of each foot link travels in a reciprocal path; and a flexibly coordinated linkage configured to connect the foot links in flexibly manner that substantially relates the movement of the first and second foot links to each other, while permitting some degree of uncoordinated motion between the foot links, whereby one foot link is urged to translate towards the forward end of the frame as the other foot link translates towards the rearward end of the frame.

28. The exercise device of claim 27, further comprising guide ramps linked together by a pivoting assembly that causes one ramp to pivot downwardly as the other ramp pivots upwardly in response to downward forces incurred from the operatively associated foot links.

29. The exercise device of claim 28, wherein the guide ramps are linked together by a transverse pivot-arm ramp return having a central pivot axis that causes one ramp to pivot downwardly as the other ramp pivots upwardly in response to downward forces incurred from the operatively associated foot links.

30. The exercise device of claim 28, wherein the foot links are connected to each other by a pulley and belt system that urges one foot link to translate towards one end of the frame as the other foot link translates towards the other end of the frame.

31. The exercise device of claim 30, wherein the belt of the pulley and belt system is flexible, allowing the foot links to be flexibly coordinated in substantially related movement.

32. The exercise device of claim 28, wherein the foot links are connected to each other by a rack and pinion system that causes one foot link to translate towards one end of the frame as the other foot link translates towards other end of the frame.

33. The exercise device of claim 32, wherein the rack and pinion system has a flexible draw that allows the foot links to be flexibly coordinated in substantially related movement.

34. The exercise device of claim 28, wherein the operative association of the foot links with the guide ramps acts to vary the angular orientation of the foot links relative to the frame.

35. The exercise device of claim 28, wherein the foot links rollably engage the guide ramps.

36. The exercise device of claim 35, wherein the guide ramps and corresponding rollably engageable foot links are shaped and sized in a configuration that facilitates the lateral containment of the rollably engageable foot links by the guide ramps.

37. The exercise device of claim 27, wherein the foot links are operatively connected to a connection axle by rotational crank arms.

38. The exercise device of claim 37, wherein the rotational crank arms move in flexibly related coordinated motion.

39. The exercise device of claim 37, wherein the operative association of the foot links with the connection axle acts to vary the angular orientation of the foot links relative to the frame.

40. The exercise device of claim 27, further comprising a flywheel operatively connected to the transverse axle, said flywheel located at approximately the midpoint of the transverse axle.

41. The exercise device of claim 27, wherein the foot links are operatively associated to a capstan type drive located at the transverse axle.

42. The exercise device of claim 41, wherein resilient members operatively connect the capstan type drive to the frame, thereby dampening the motion of the rollably associated foot links on the transverse axle as the foot support portion of each foot link travels in a reciprocal path.

43. The exercise device of claim 41, wherein the device further comprises:

(a) a center housing located at approximately the midpoint of the transverse axle, whereby the center housing is capable of enclosing a flywheel; and (b) pinch/idler rollers extending outwardly from the center housing above the transverse axle to rollably engage the foot links.

44. The exercise device of claim 43, wherein the capstan type drive is configured to form spool-shaped drive wheels, and the pinch/idler rollers and the spool-shaped drive wheels are positioned to act in conjunction with each other to capture a corresponding foot link therebetween and thus, provide lateral retention of the foot links.

45. The exercise device of claim 27, wherein the foot links are operatively associated with a one-way clutch by way of the transverse axle.

46. The exercise device of claim 27, wherein the one-way clutch imports a greater resistance when the foot support portions of the foot links move from a forward to the rearward position than in moving from a rearward to a forward position.

47. The exercise device of claim 27, wherein the level of resistance imported by the one-way clutch is adjustable.

48. An exercise device, comprising:

a frame having a transverse axle defined thereon, the frame configured to be supported on a floor;

a first and second foot link, each foot link including a first end portion, a second end portion, and a foot support portion, wherein a portion of each foot link rollably engages the exercise device;

a drive system operatively associated with each foot link;

rotational crank arms operatively connected to the transverse axle;

a flexibly coordinating mechanism that substantially relates the movement of the first and second foot links to each other, while permitting some degree of uncoordinated motion between the foot links; and whereby as the first and second foot links travel forward and aft, the foot support portions of the foot links travel along elliptical paths.

* * * * *

UNITED STATES PATENT AND TRADEMARK OFFICE

CERTIFICATE OF CORRECTION

PATENT NO. : 6,165,107
DATED : December 26, 2000
INVENTOR(S) : J.S. Birrell

It is certified that error appears in the above-identified patent and that said Letters Patent is hereby corrected as shown below:

Title page, Item [57],
Abstract, "ramps, causes" should read -- ramps causes --

Column 1,
Line 22, "equipment, is" should read -- equipment is --
Line 29, "art, however this" should read -- art; however, this --
Line 36, "thereby, limits" should read -- thereby limits --
Line 40, "bicycles, however," should read -- bicycles; however, --
Line 49, "art, is" should read -- art is --
Line 65, "motion produced" should read -- of motion produced --

Column 2,
Line 39, "(i.e. the" should read -- (i.e., the --
Line 42, "connects" should read -- connected --
Line 51, "and thus the foot links" should read -- and thus the foot links, --

Column 3,
Line 14, "natural" should read -- naturally --
Line 31, "is flexibly" should read -- are flexibly --
Line 42, "is flexibly" should read -- are flexibly --
Line 42, "by rack" should read -- by a rack --

Column 4,
Line 23, "generates" should read -- generate --
Line 31, "cups that are mounted" should read -- cups are mounted --
Line 46, "members, that" should read -- members that --

Column 5,
Line 34, "137A, are" should read -- 137A are --

Column 6,
Line 62, "70, includes" should read -- 70 includes --

Column 9,
Line 48, "ramps such as" should read -- ramps, such as --

Column 11,
Line 61, "their" should read -- that --
Line 65, exercisers however," should read -- exercisers, however, --

UNITED STATES PATENT AND TRADEMARK OFFICE

CERTIFICATE OF CORRECTION

PATENT NO. : 6,165,107
DATED : December 26, 2000
INVENTOR(S) : J.S. Birrell

It is certified that error appears in the above-identified patent and that said Letters Patent is hereby corrected as shown below:

Column 12,
Line 5, "23 1A" should read -- 231A --
Line 9, "23 1A" should read -- 231A --

Column 15,
Line 26 (claim 27, line 15), "in flexibly manner" should read -- in a flexible manner --
Line 53 (claim 32, line 4), "towards other" should read -- towards the other --

Signed and Sealed this

Ninth Day of October, 2001

*Attest:*

Nicholas P. Godici

*Attesting Officer*

NICHOLAS P. GODICI
*Acting Director of the United States Patent and Trademark Office*